US008042653B2

(12) United States Patent
Grebinoski et al.

(10) Patent No.: US 8,042,653 B2
(45) Date of Patent: Oct. 25, 2011

(54) ADJUSTABLE WORK PLATFORM

(75) Inventors: James J. Grebinoski, Mercer, PA (US); Donna L. Cousins, Mercer, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 11/049,453

(22) Filed: Feb. 2, 2005

(65) Prior Publication Data

US 2006/0169539 A1 Aug. 3, 2006

(51) Int. Cl.
*E04G 5/00* (2006.01)

(52) U.S. Cl. ..... 182/223

(58) Field of Classification Search ..... 182/223, 182/222, 118, 119, 27, 153, 155, 207, 209, 182/115
See application file for complete search history.

(56) References Cited

U.S. PATENT DOCUMENTS

| | | | | | |
|---|---|---|---|---|---|
| 1,359,297 | A * | 11/1920 | Voss | 182/207 |
| 1,359,452 | A * | 11/1920 | Walker | 182/222 |
| 1,377,095 | A * | 5/1921 | Rupp | 182/155 |
| 2,186,484 | A * | 1/1940 | Gunther | 182/118 |
| 2,729,516 | A * | 1/1956 | Colvin | 182/155 |
| 3,128,842 | A * | 4/1964 | Satrum | 182/149 |
| 3,692,143 | A * | 9/1972 | Kummerlin et al. | 182/24 |
| 3,730,465 | A * | 5/1973 | Gonzalez | 248/188.6 |
| 5,067,589 | A * | 11/1991 | Bartnicki | 182/223 |
| 6,892,860 | B2 * | 5/2005 | Gibson et al. | 182/222 |

* cited by examiner

*Primary Examiner* — Alvin Chin Shue
(74) *Attorney, Agent, or Firm* — Ansel M. Schwartz

(57) ABSTRACT

An adjustable work platform includes a first ladder section and a second ladder section, each of which is adjustable in height. The platform includes a deck assembly adjustable in length supported by the first and second ladder sections. The deck assembly includes a first deck half and a second deck half that slide relative to each other and fit together. A method for using an adjustable work platform including the steps of extending the height of a first ladder section and a second ladder section. There is the step of sliding a first deck half relative to a second-half that fit together of a deck assembly to a desired length. The deck assembly supported by the first and second ladder sections.

7 Claims, 21 Drawing Sheets

ENGAGED POSITION

DISENGAGED POSITION

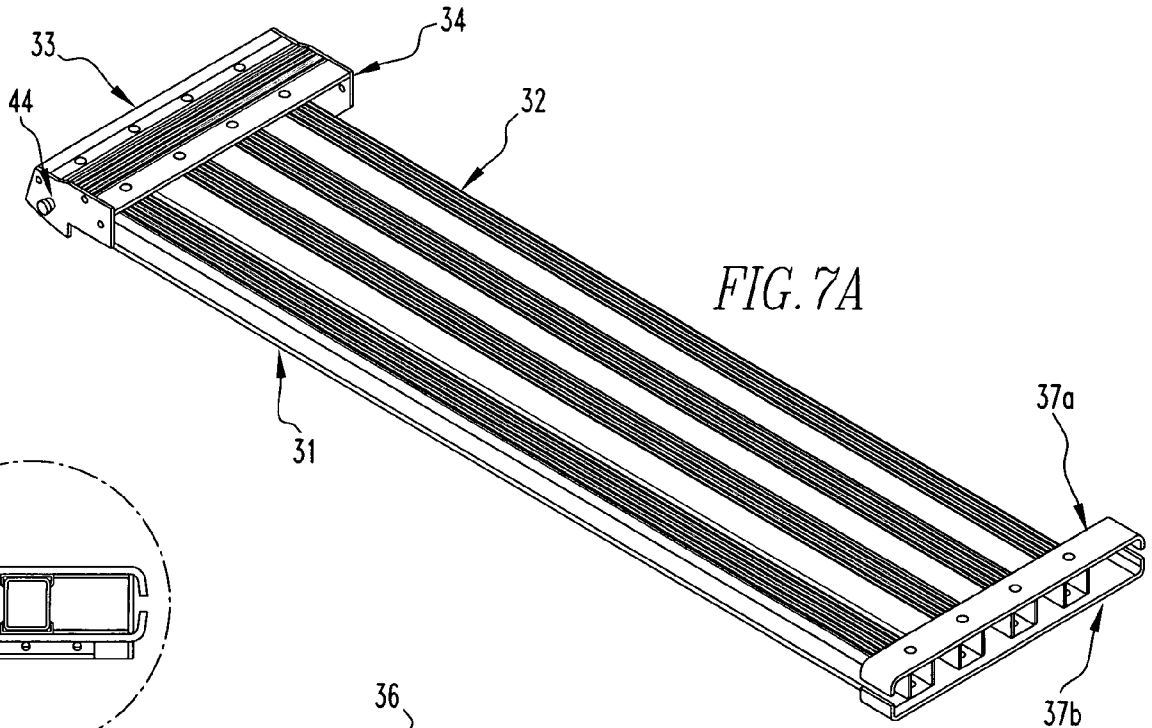
FIG. 7A
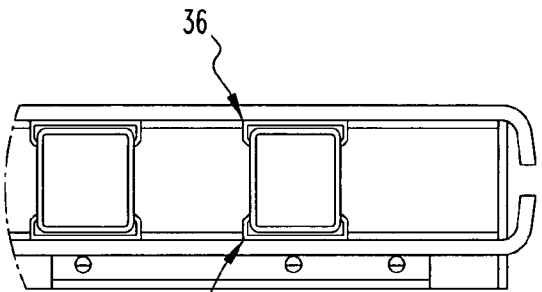
FIG. 7C
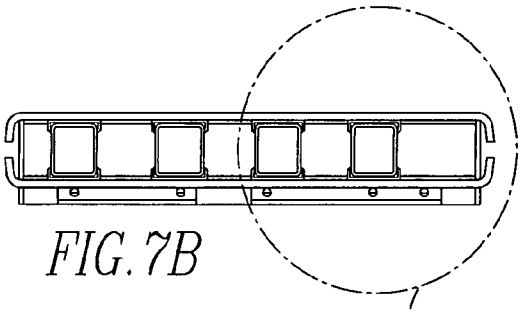
FIG. 7B
FIG. 7C (EFFECTIVE HEIGHT ENGAGED)

(EFFECTIVE HEIGHT DISENGAGED)

31
38
37
39

31
37
39
38

ADJUSTABLE WORK PLATFORM

FIELD OF THE INVENTION

The present invention is related to an adjustable work platform. More specifically, the present invention is related to an adjustable work platform which is adjustable in length and in height.

BACKGROUND OF THE INVENTION

Many homeowners today do their own maintenance and improvements to their homes. Several tasks such as painting and cleaning walls or ceilings require climbing ladders and reaching to gain access to certain areas. This can create a potential hazard such as falls from ladders as people overextend themselves and lose their balance. This also can create the inconvenience of climbing up and down ladders and repositioning them as the task progresses. This can become cumbersome and time consuming. Other options include multiple pieces of equipment which can be assembled together to form scaffolding. This can become expensive and cumbersome to use, as well as a potential hazard if not assembled correctly.

The primary purpose of this invention is, through the use of one product, to provide a means of reaching high spaces as well as provide the ability to traverse that space without reaching or readjusting equipment.

SUMMARY OF THE INVENTION

The present invention pertains to an adjustable work platform. The platform comprises a first ladder section and a second ladder section, each of which is adjustable in height. The platform comprises a deck assembly adjustable in length supported by the first and second ladder sections. The deck assembly includes a first deck half and a second deck half that slide relative to each other and fit together.

The present invention pertains to a method for using an adjustable work platform. The method comprises the steps of extending the height of a first ladder section and a second ladder section. There is the step of sliding a first deck half relative to a second-half that fit together of a deck assembly to a desired length. The deck assembly supported by the first and second ladder sections.

BRIEF DESCRIPTION OF THE DRAWINGS

In the accompanying drawings, the preferred embodiment of the invention and preferred methods of practicing the invention are illustrated in which:

FIGS. 7-7*c* show various aspects of the deck assembly.

DETAILED DESCRIPTION

Figure 1:
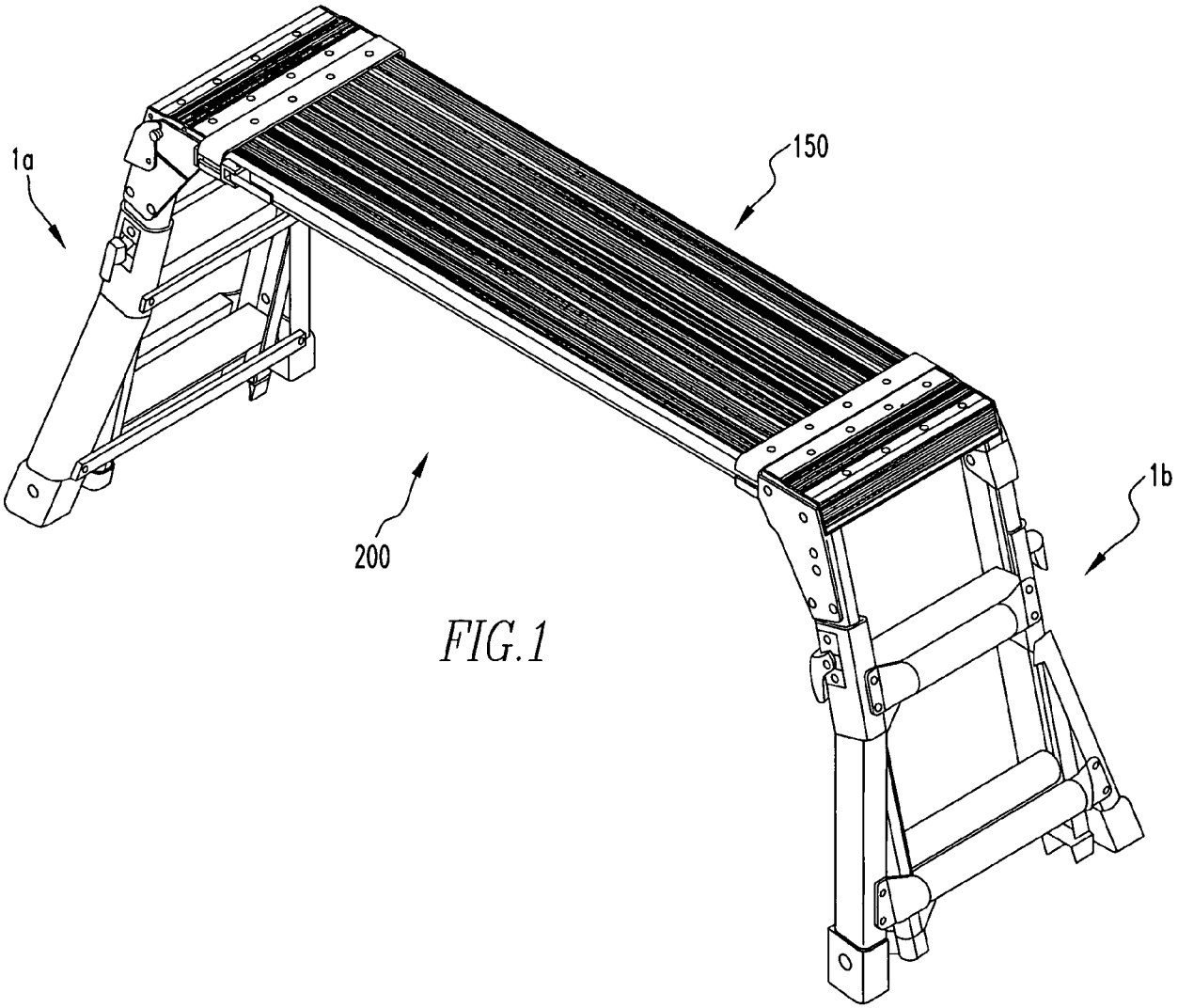
FIG. 1 is a perspective view of an adjustable work platform of the present invention.

Referring now to the drawings wherein like reference numerals refer to similar or identical parts throughout the several views, and more specifically to FIG. 1 thereof, there is shown an adjustable work platform 200. The platform 200 comprises a first ladder section 1*a* and a second ladder section 1*b*, each of which is adjustable in height. The platform 200 comprises a deck assembly 150 adjustable in length supported by the first and second ladder sections 1*a*, 1*b*. The deck assembly 150 includes a first deck half 120*a* and a second deck half 120*b* that slide relative to each other and fit together.

Figure 3:
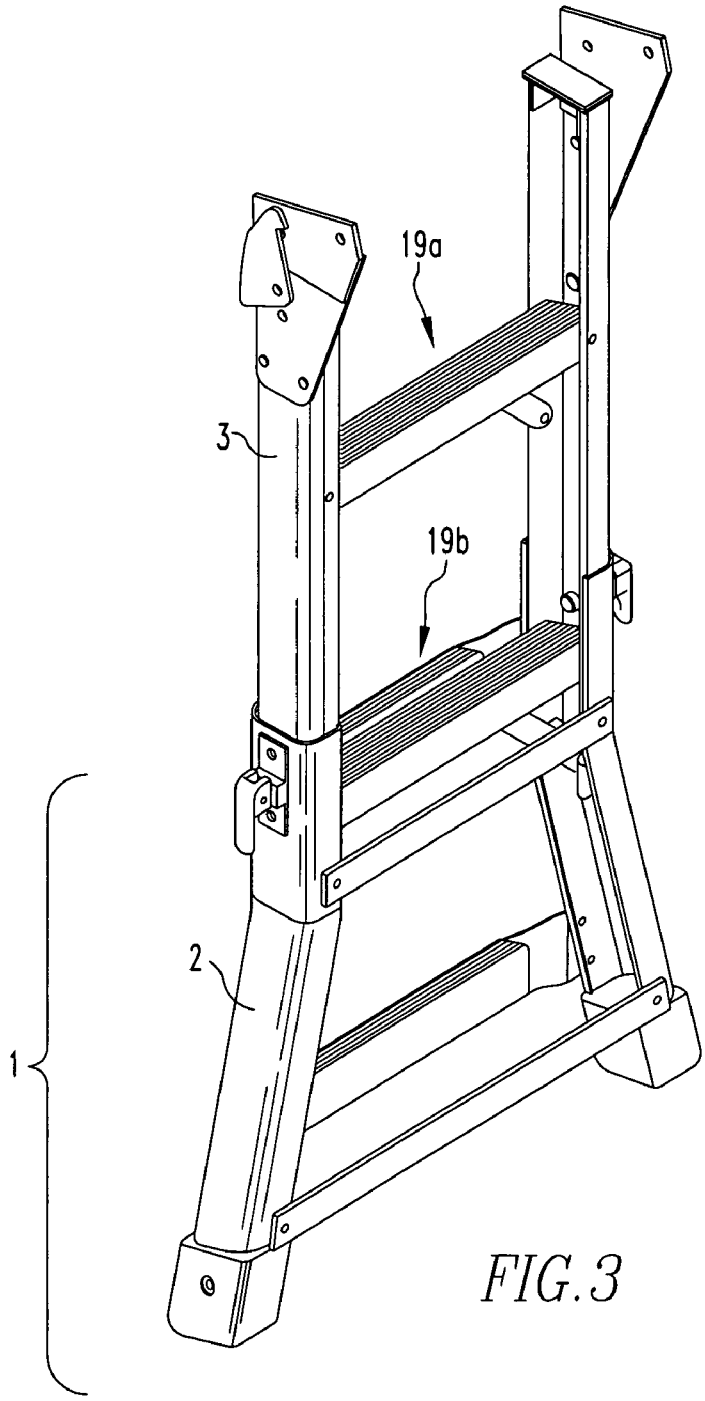
FIG. 3 is a perspective view of a ladder section.
Figure 4:
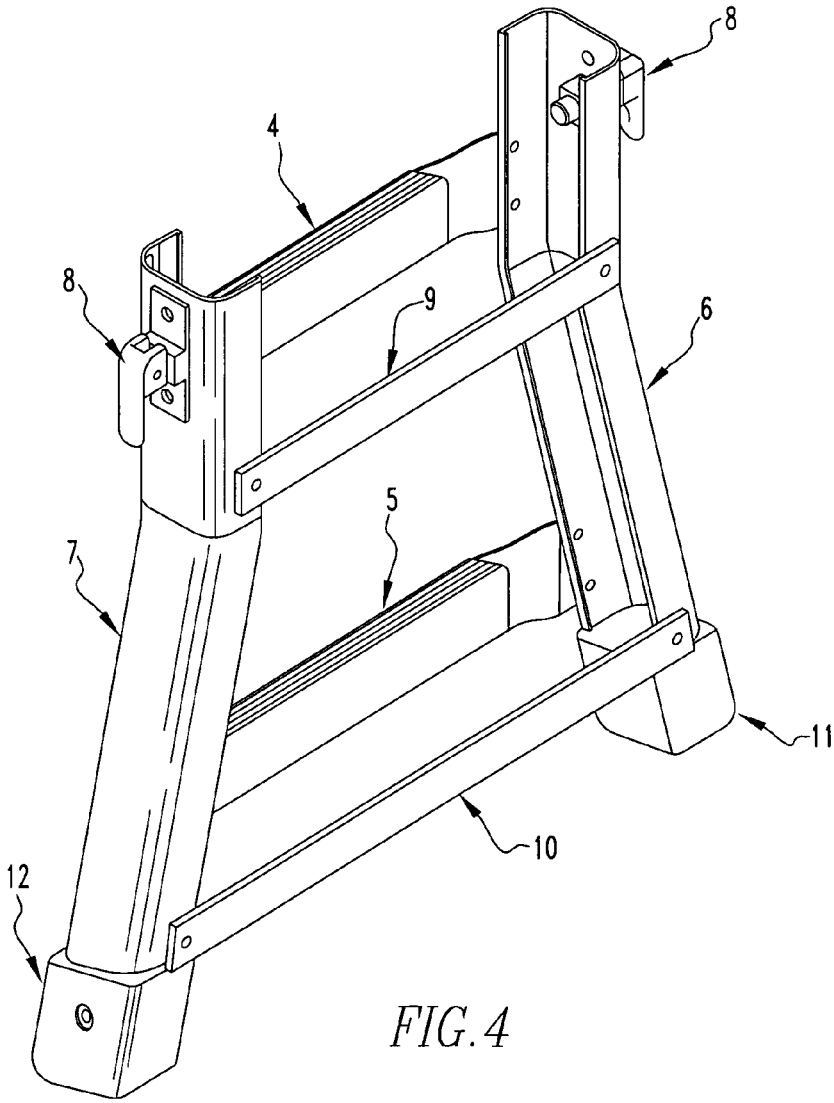
FIG. 4 is a perspective view of an outer ladder assembly.
Figure 7:
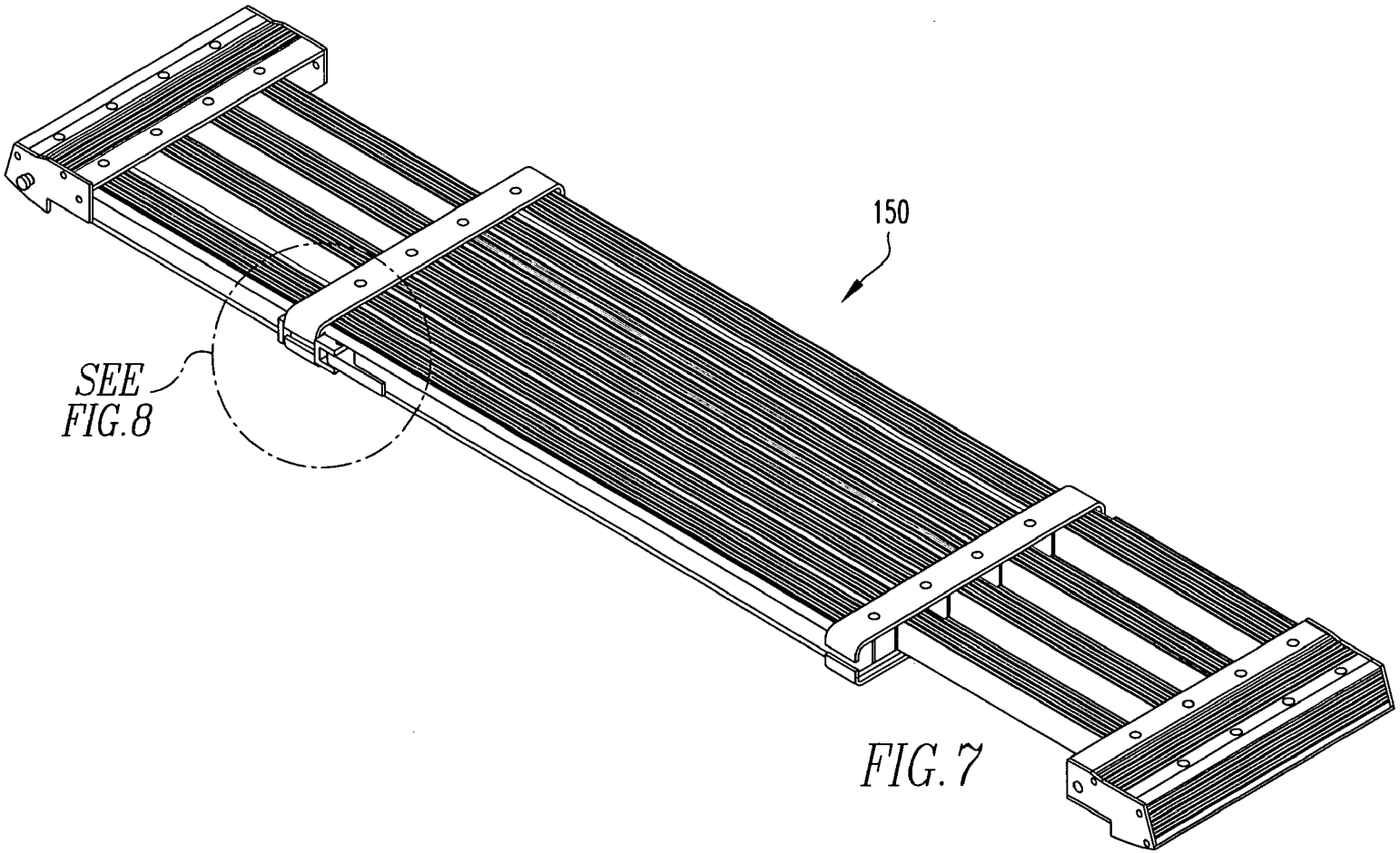

Preferably, each ladder section includes an outer ladder assembly 2 and an inner ladder assembly 3 that move relative to each other, as shown in FIG. 3. Each deck half preferably has an outer deck rail 31 and a plurality of inner deck rails 32, as shown in FIG. 7. The inner deck rails 32 of the first deck half 120*a* fit between the inner deck rails 32 of the second deck half 120*b*. Preferably, each outer ladder assembly 2 includes a top rung 4 and a lower rung 5, and a first outer rail 6 and a second outer rail 7 which are connected by the top rung 4 and the lower rung 5, as shown in FIG. 4.

Figure 9A:
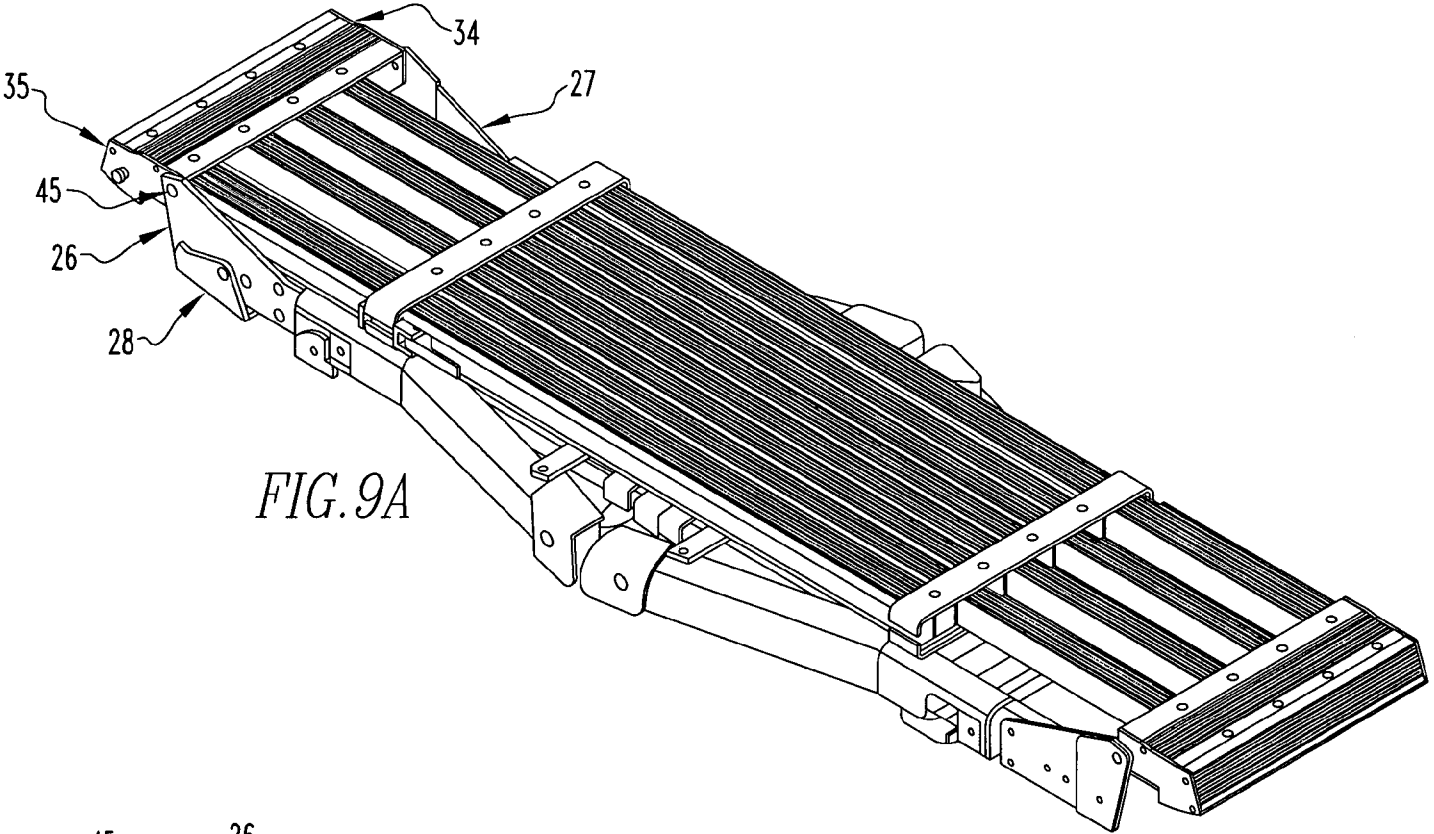
FIGS. 9*a*-9*c* show the platform in various positions.

Each ladder section preferably folds onto the deck section into a collapsed position, as shown in FIG. 9*a*. Preferably, each ladder section includes a first latch assembly 8*a* and a second latch assembly 8*b*, and each first outer rail 6 and each second outer rail 7 have a hole 41 through which the first and second latch assemblies mount to the first and second outer rails 6, 7, respectively, as shown in FIGS. 4 and 5*a*-5*e*. Each inner ladder assembly 3 preferably includes a first inner rail 20 and a second inner rail 21, and a first step 19*a* and a second step 19*b* which are attached to the first and second inner rails 20, 21, as shown in FIG. 6*a*.

Preferably, the deck assembly 150 includes a deck end extrusion 33, rail guides 36 and a top cross bar 37*a* and a bottom cross bar 37*b*, and each outer and inner deck rail 31, 32 are attached to the deck end extrusion 33, corresponding rail guides 36 and the top and bottom crossbars, as shown in FIGS. 7-7*c*. The inner ladder assembly 3 preferably includes a pivot plate 26 attached to each inner rail, and a latch mechanism 28 pivotally attached to each inner rail and the pivot plate 26. The deck assembly 150 pivotally attached to each inner ladder assembly 3 through each of the pivot plates. See FIGS. 6*a*-6*c*.

Preferably, the first latch assembly 8*a* includes a latch housing 13 having a hole 14 and fits through the hole 41 in the first outer rail 6 and also attached to the first outer rail 6, a latch pin 14 which fits through the hole 15 in the latch housing 13, and a release handle 16 pivotally fixed to the latch pin 14 by a connection pin. The latch pin 14 is inwardly biased by a compression spring 18. See FIGS. 4 and 5*a*-5*e*. The deck assembly 150 preferably includes a deck adjustment clamp 160 for securing each deck half together. See FIGS. 8*a* and 8*c*, 13*a* and 13*b*. Preferably, the deck adjustment clamp 160 includes a clamp block 39 and a clamp handle 38 pivotally amounted to the clamp block 39. The clamp block 39 configured such that it fits with the outer deck rail 31 and in an engaged position clamps against the outer deck rail 31 to hold the outer deck rail 31 in place and in a disengaged position allows the outer deck rail 31 to move relative to the clamp block 39.

Figure 12A:
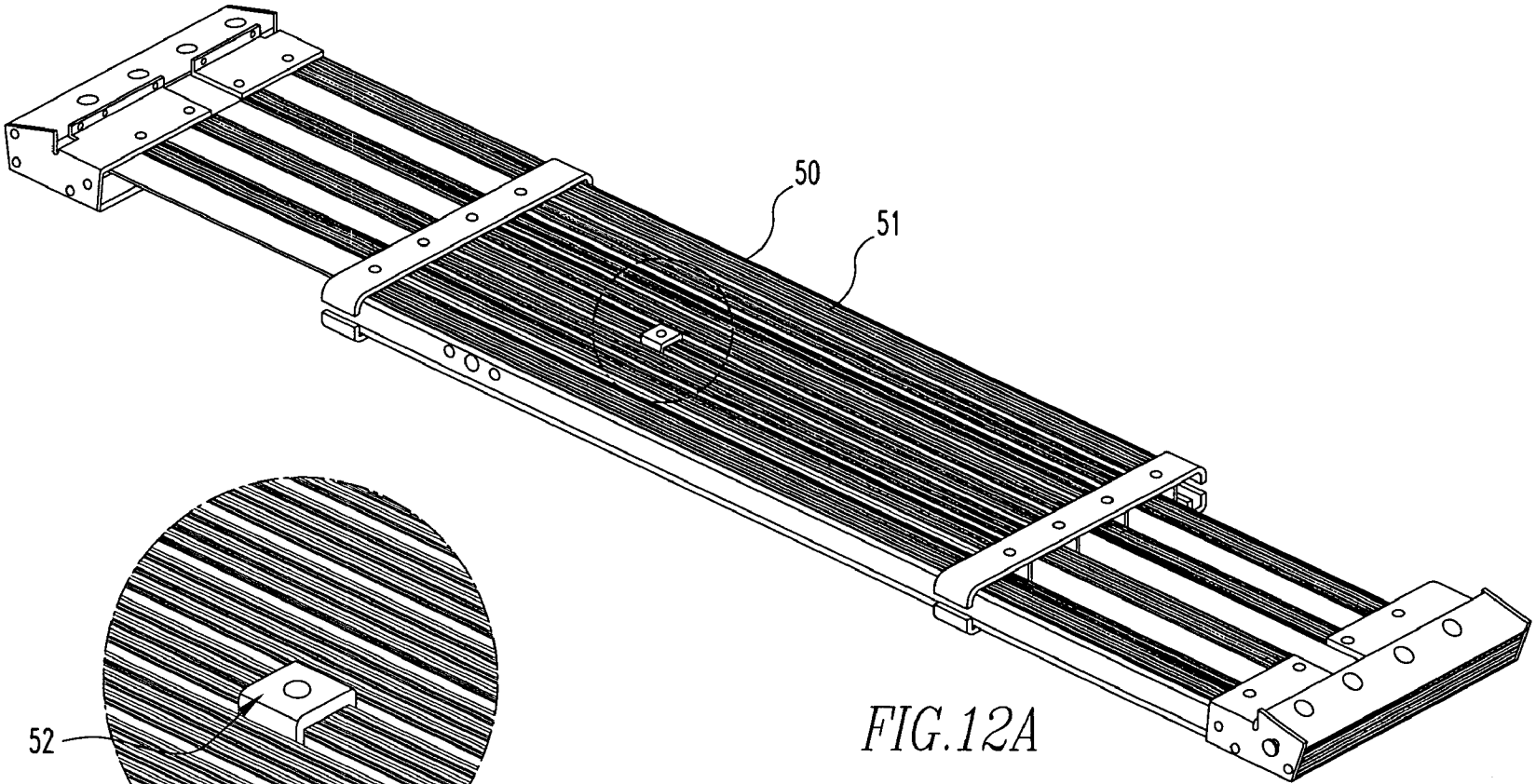
FIGS. 12*a*-12*d* show the deck assembly with stop in various positions.
Figure 12B:
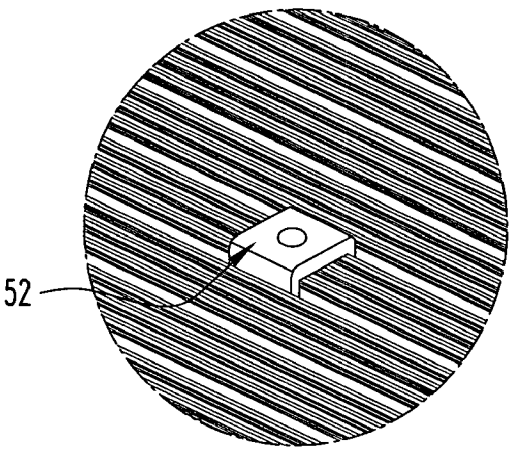
Figure 12C:
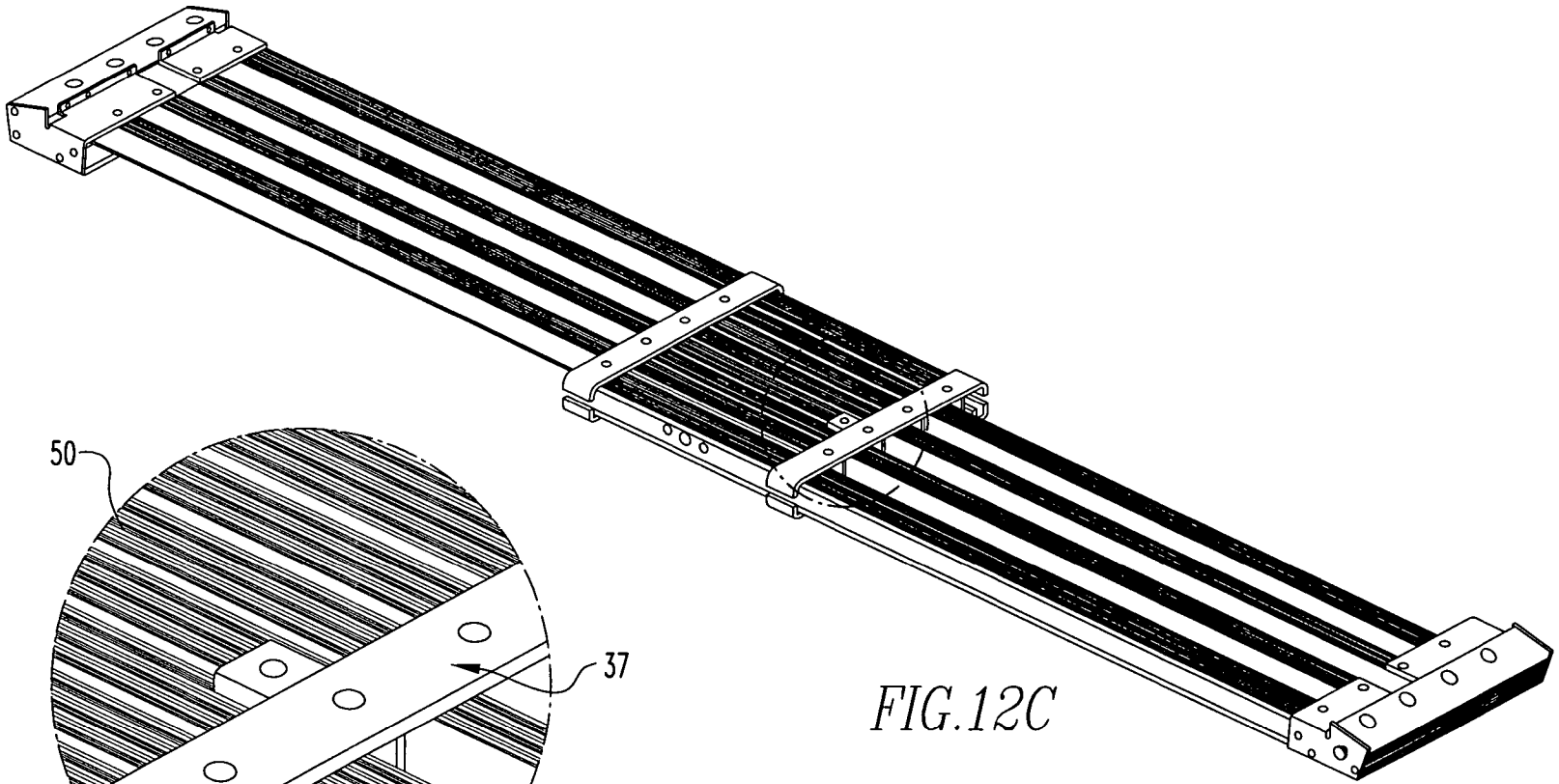
Figure 12D:
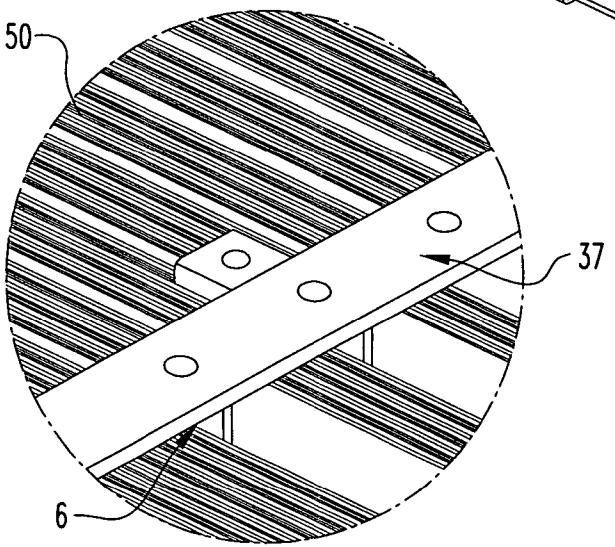
Figure 13A:
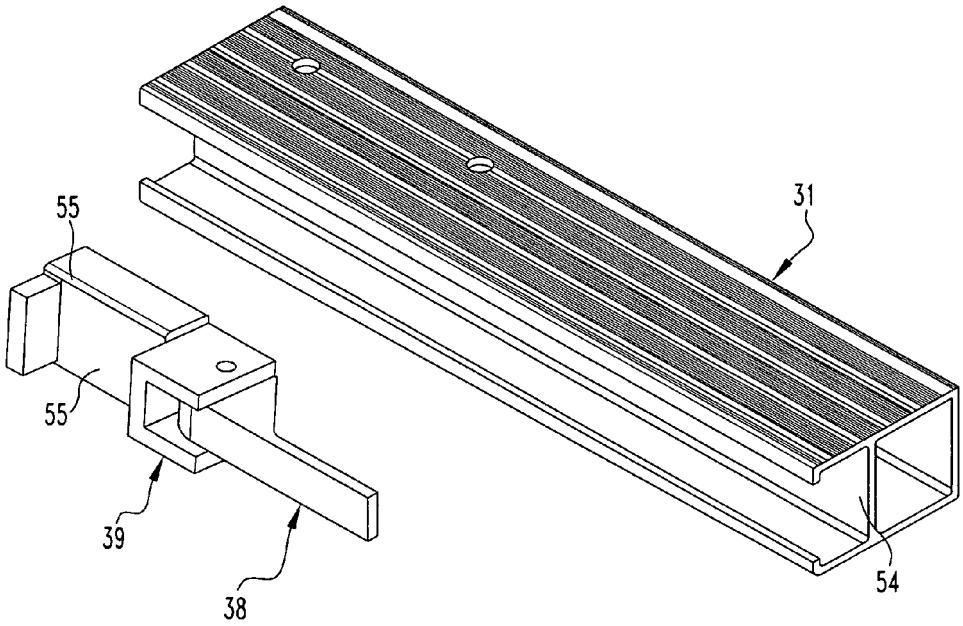
FIGS. 13*a* and 13*b* show various views of the deck adjustment clamp.
Figure 13B:
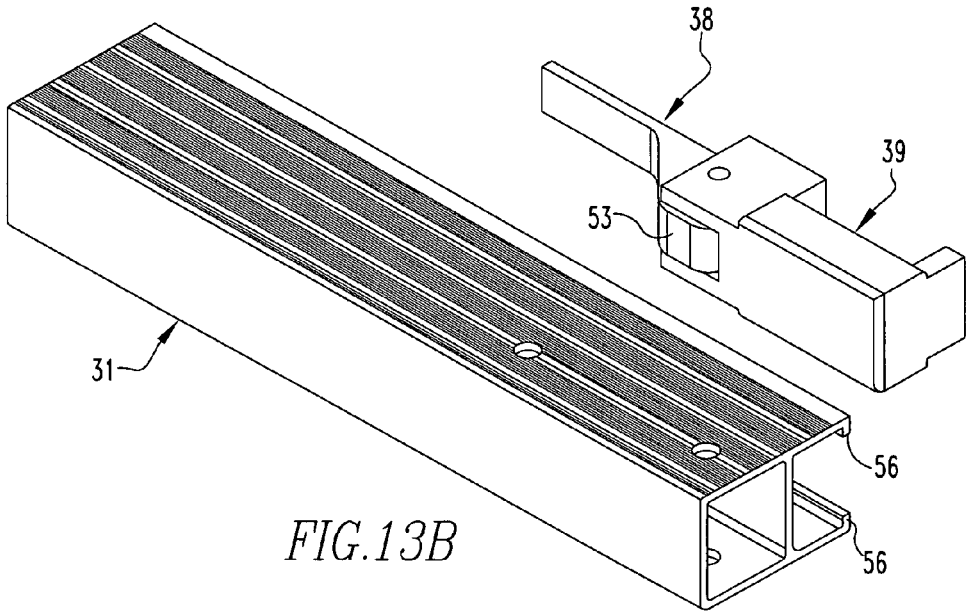

Each outer rail preferably flares outwardly. Preferably, each inner rail has a plurality of holes 23. The height of each ladder section is set by the hole 23 of the inner rail through which the latch pin 14 of the latch assembly extends, see FIGS. 3, 6*a* and 10*c*. The deck assembly 150 preferably includes a stop 50 for preventing the first and second deck halves from extending too far and separating from each other. See FIGS. 12*a* and 12*d*.

The present invention pertains to a method for using an adjustable work platform 200. The method comprises the steps of extending the height of a first ladder section 1*a* and a second ladder section 1*b*. There is the step of sliding a first deck half 120*a* relative to a second-half that fit together of a deck assembly 150 to a desired length. The deck assembly 150 supported by the first and second ladder sections 1*a*, 1*b*.

Preferably, there is the step of moving an inner ladder assembly 3 relative to an outer ladder assembly 2 of each ladder section. There is preferably the step of folding the first and second ladder sections 1*a*, 1*b* onto the deck assembly 150 into a collapsed position. Preferably, there is the step of placing a first latch assembly 8*a* and a second latch assembly 8*b* on a first outer rail 6 and a second outer rail 7, respectively, through a hole 23 of a first inner rail 20 and a second inner rail 21, respectively, of the inner ladder assembly 3 to lock the inner ladder assembly 3 to the outer ladder assembly 2. There is preferably the step of setting a deck adjustment clamp 160 into an engaged position against the outer deck rail 31 of the deck assembly 150 to hold the deck half 120*a* in place relative to the deck half 120*b*.

Figure 2:
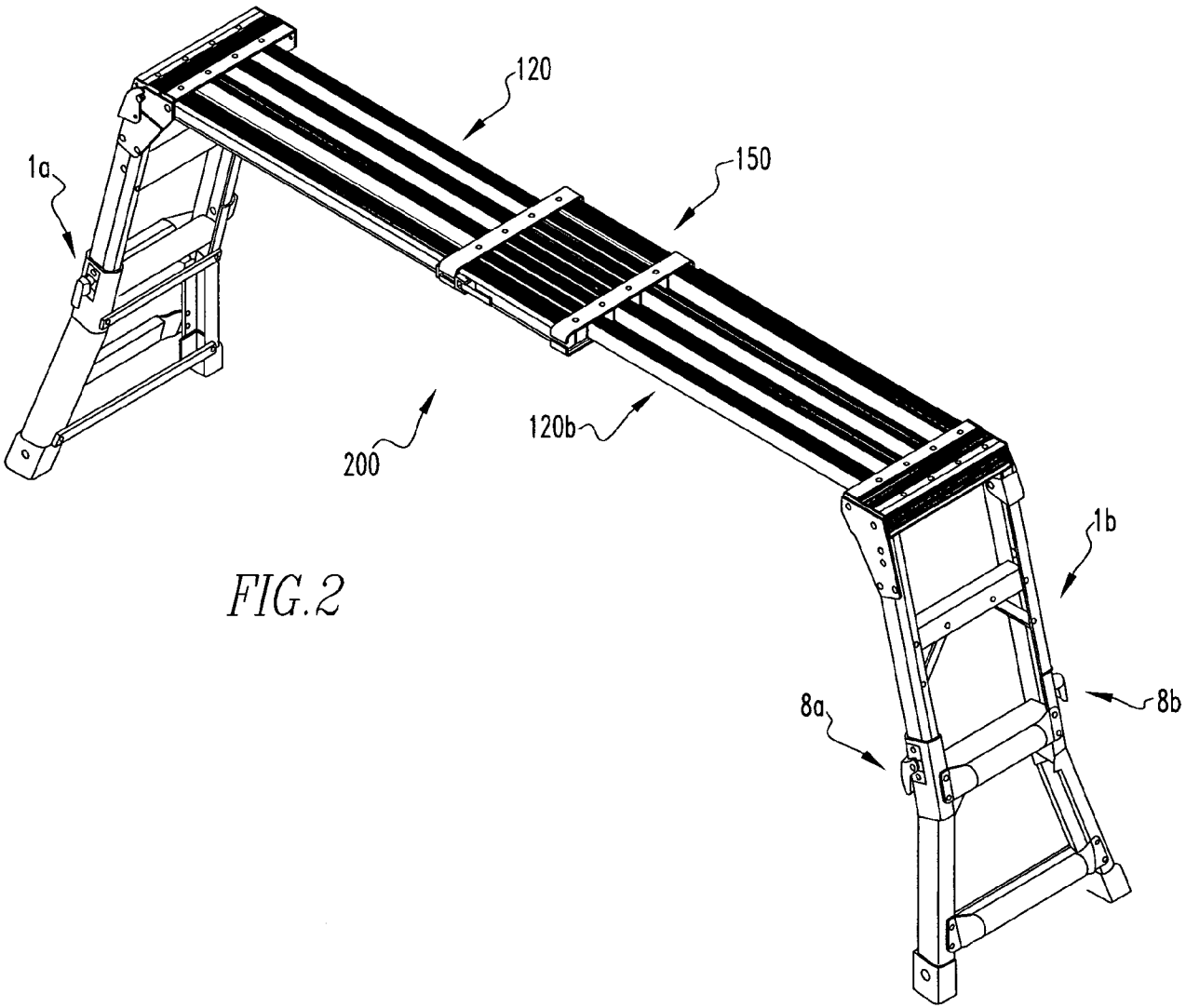
FIG. 2 is a perspective view of the platform.

In the operation of the invention, FIGS. 1 and 2 show the overall views of the Adjustable Work Platform 200. This platform 200 basically telescopes in the vertical and horizontal directions. The vertical direction has two distinct positions as it adjusts in height from 24 inches to 34 inches. The horizontal length of the platform 200 is infinitely adjustable between 46 inches and 72 inches. FIG. 1 shows the platform 200 in its lowest and most retracted position. FIG. 2 shows the platform 200 in its highest and most extended position. Although these two configurations are shown, any combination of height and infinite length adjustment is permissible.

The platform 200 consists of two primary sections, the ladder section 1 and the deck assembly 150.

The ladder section 1 is shown in FIG. 3. The ladder section consists of an outer ladder assembly 2, and an inner ladder assembly 3.

FIG. 4 shows the outer ladder assembly 2 in detail. It consists of an aluminum top rung 4 and an aluminum lower rung 5 which rigidly connect two aluminum outer rails 6 and 7. The outer rails have holes 41 (see FIG. 5*e*) near the top which allow the mounting of a latch assembly 8. Support straps 9 and 10 also are rigidly connected to outer rails 6 and 7. Polymer type feet 11 and 12 are attached to each outer rail.

Figure 5A:
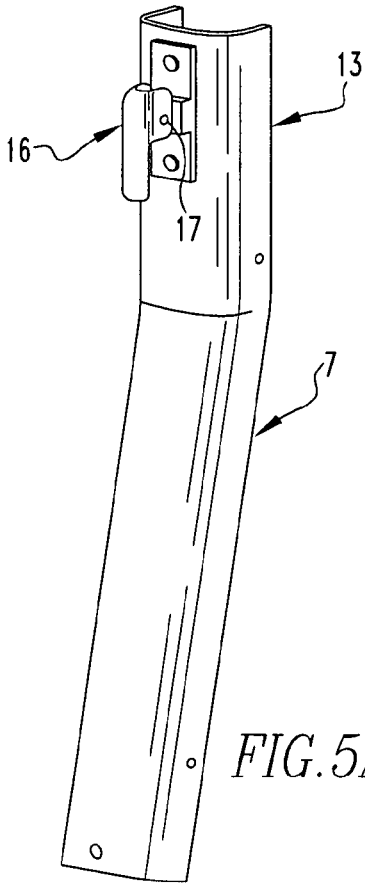
FIGS. 5*a*-5*e* show various aspects of the latch assembly of the ladder section.
Figure 5E:
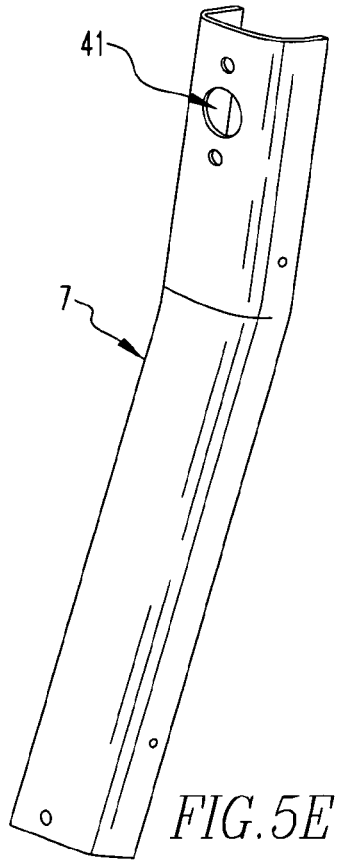
Figure 5D:
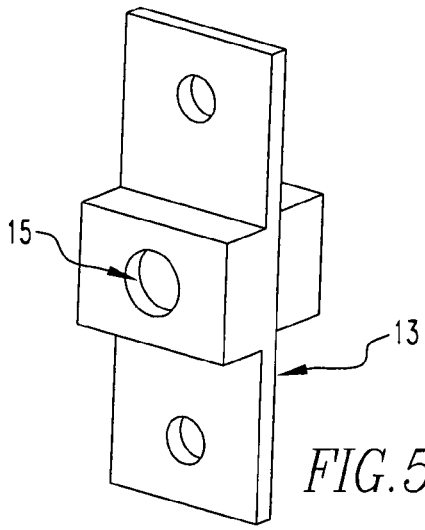
Figure 5B:
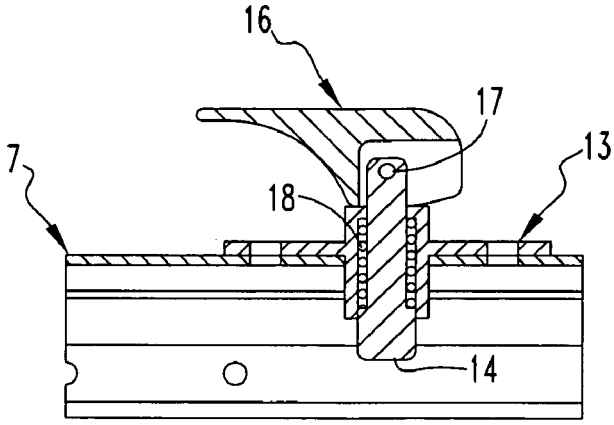
Figure 5C:
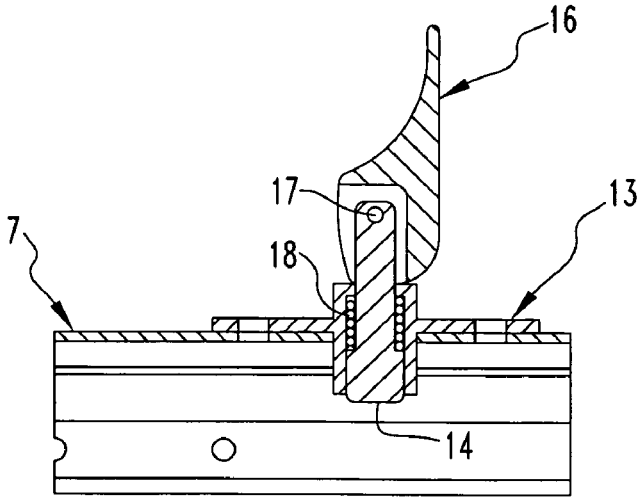
Figure 6A:
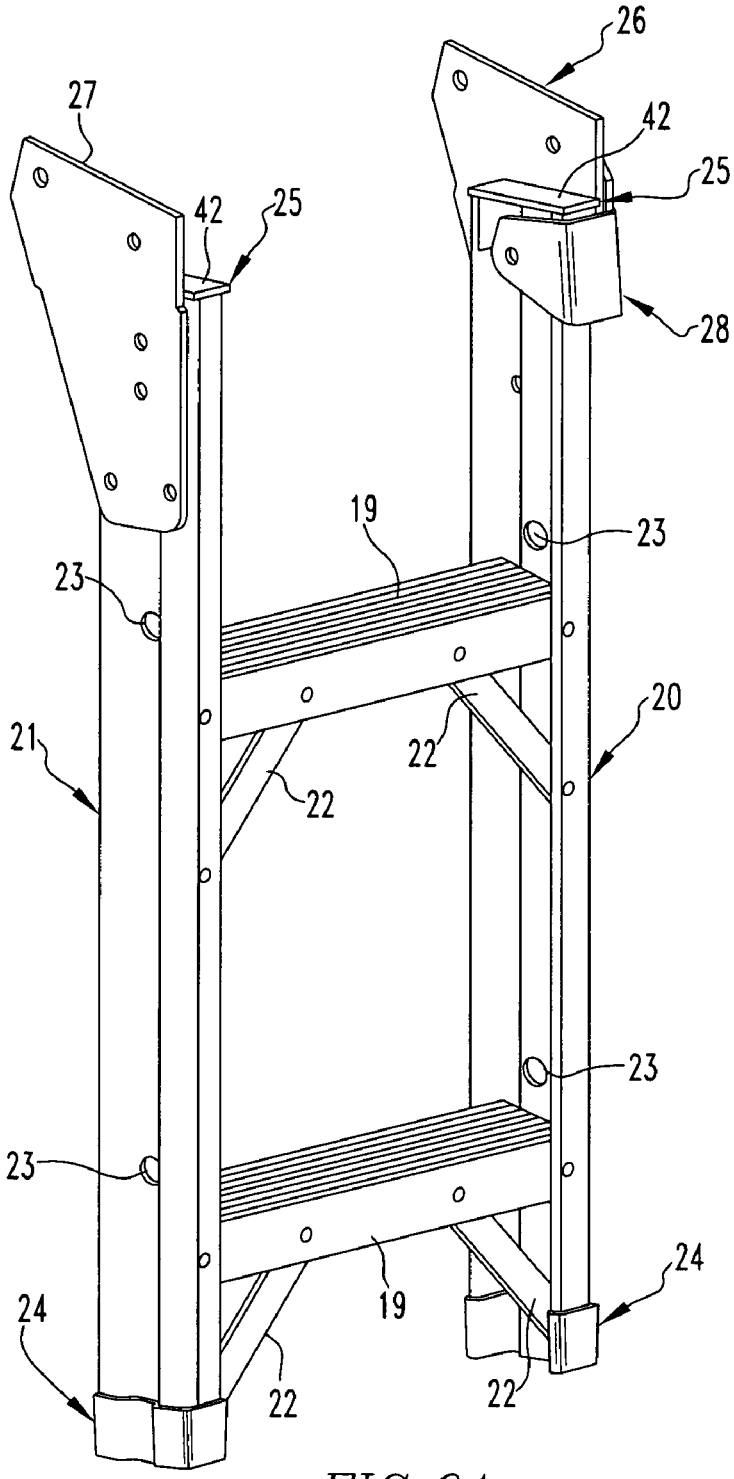
FIGS. 6*a*-6*c* show various aspects of the inner ladder assembly.

The latch assembly is shown in FIGS. 5*a*-5*c*. The latch housing 13 is rigidly attached to the outer rails 6, 7. The latch pin 14 fits through the hole 15 (FIG. 5*d*) in the latch housing 13 and hole 41 (FIG. 5*e*) in the outer rails 6, 7, and is pivotally fixed to the release handle 16 by a connection pin 17. Furthermore, the latch pin 14 is inwardly biased by a compression spring 18. The release handle 16 has an engaged position FIG. 5*b* and a disengaged position FIG. 5*c*. Each outer ladder assembly 2 has two latch assemblies.

Figure 6B:
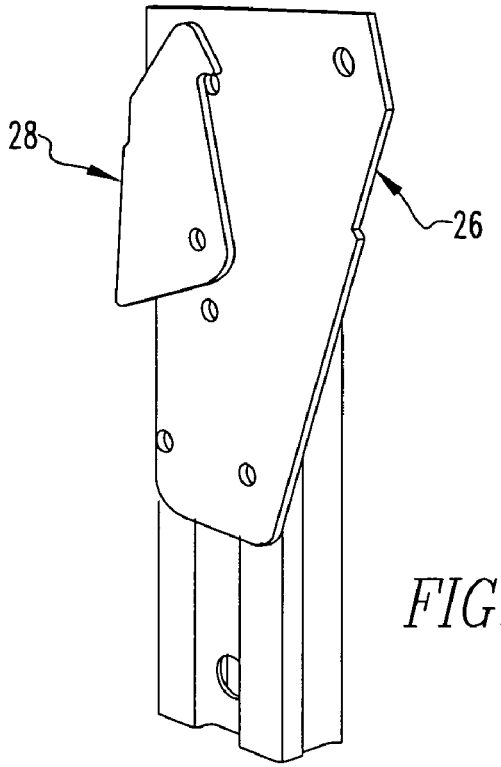
Figure 6C:
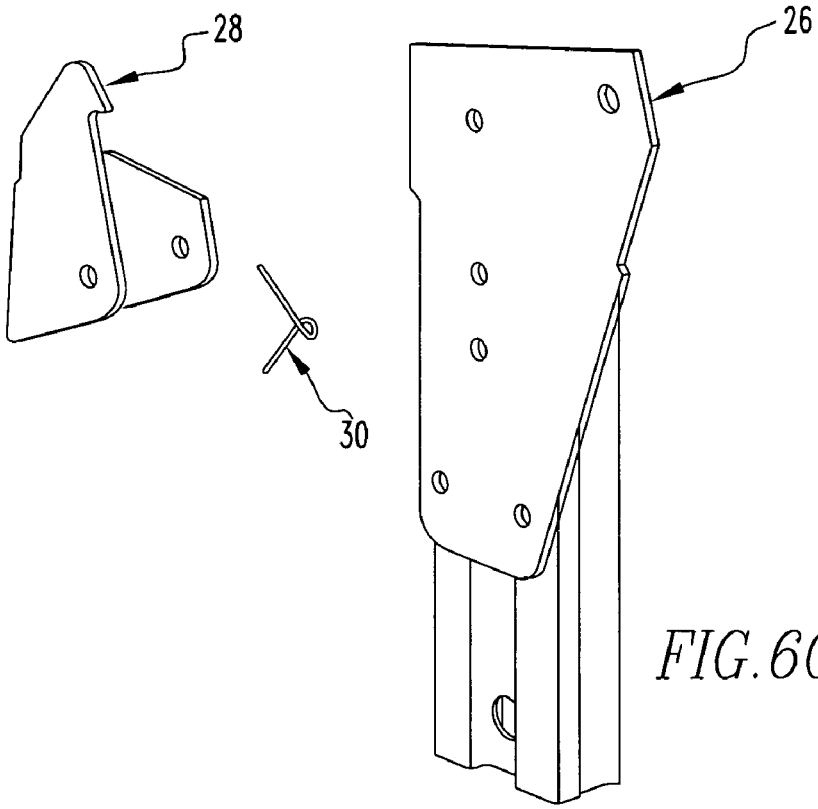

FIG. 6*a* shows the inner ladder assembly 3 in detail. It consists of two aluminum steps 19 rigidly attached to inner rails 20 and 21. Each step has two supports 22 rigidly affixed between the step 19 and the inner rails 20 and 21. Each inner rail 20, 21 has two holes 23 which will be used for height adjustment, which will be explained later. A plastic rail end cap 24 is fixed to the bottom of each inner rail 20, 21. A plastic end cap 25 is attached to the top end of each inner rail 20, 21. Steel pivot plates 26 and 27 are rigidly attached to the top of and to the outside surface of each inner rail 20, 21. A steel latch mechanism 28 is pivotally attached to inner rail 20 and pivot plate 26, as shown in FIG. 6*b*. The latch assembly consists of a steel hook 29 and coil spring 30, as shown in FIG. 6*c*.

Each platform 200 assembly includes two outer rail assemblies FIG. 4 and two inner rail assemblies FIG. 6.

Figure 8:
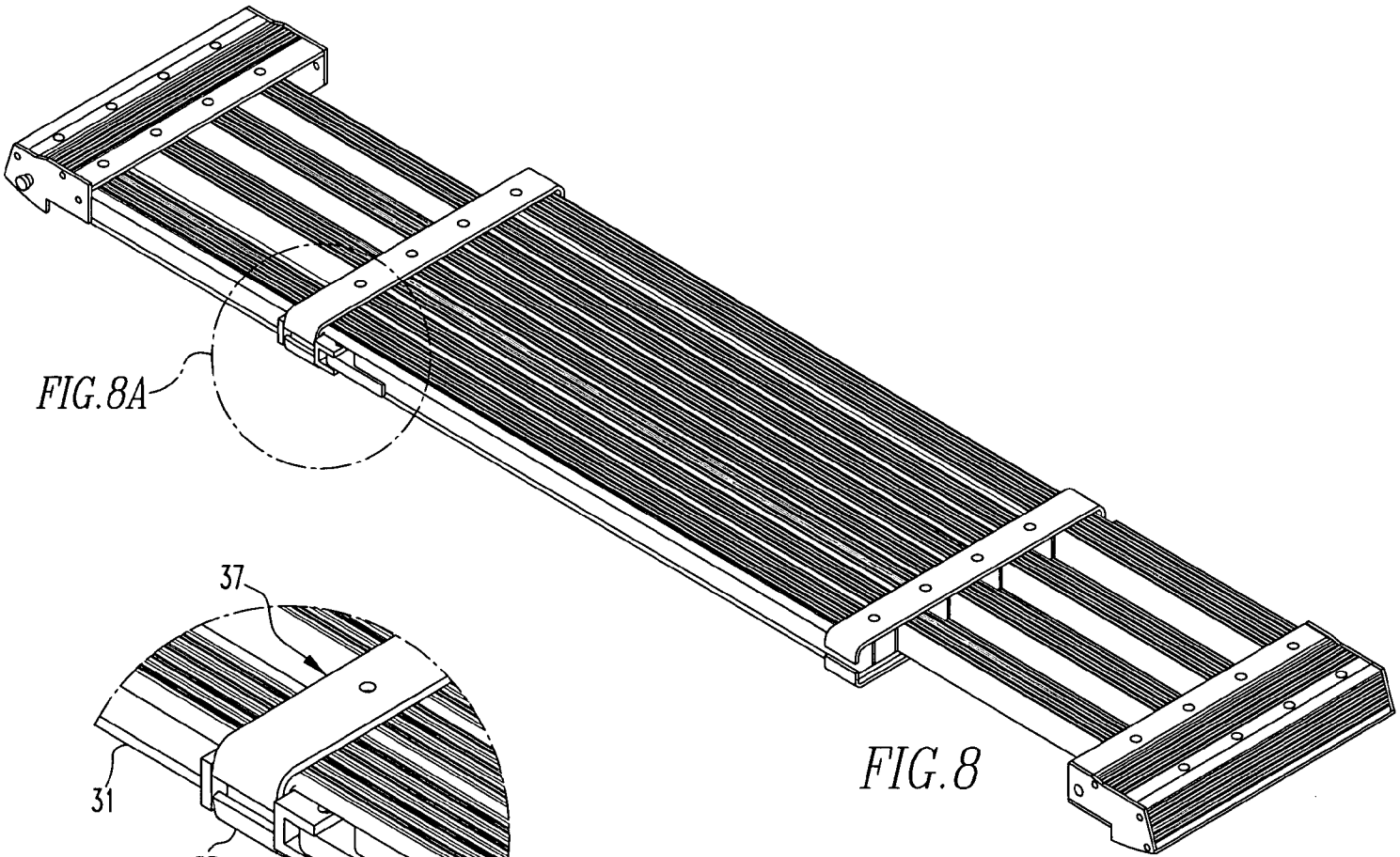
FIGS. 8-8*c* show various aspects of the deck adjustment clamp.

FIGS. 7*b*-7*c* and FIG. 8 show the deck assembly 150. Each deck assembly 150 is comprised of two deck halves, 120*a*, 120*b*. See FIG. 7*a*. Each deck half consists of one outer deck rail 31 and at least three inner deck rails 32. The space between the outer deck rail 31 and the inner deck rail 32 is a minimum of the width of the inner deck rail 32. Each outer and inner deck rail 31, 32 is rigidly attached to the aluminum deck end extrusion 33 and steel pivot brackets 34 and 35. The steel pivot brackets 34 and 35 are also rigidly attached to the aluminum deck end extrusion 33. At the opposing end of the deck half, the inner and outer deck rails 32, 31 are affixed to plastic guides 36 (FIG. 7*c*) and top and bottom cross bars 37*a*, 37*b*.

Two deck halves are used to make a single deck assembly 150. The deck halves are assembled such that the inner deck rails 32 of each half fit between the inner deck rails 32 of the opposite half. The deck assembly 150 is also configured such that the outer rail 31 of each deck half is opposite the other and each would be the first rail or last rail in the assembly. Refer to FIGS. 7*a*-7*c*.

Figure 8A:
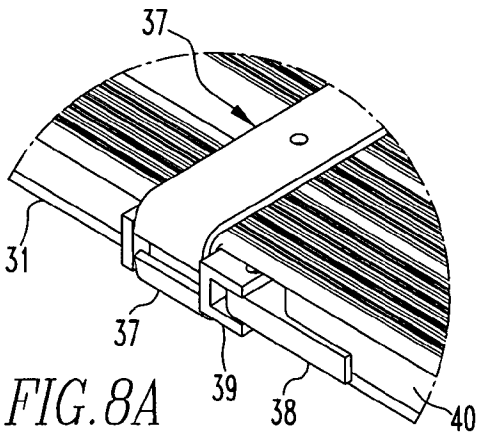
Figure 8B:
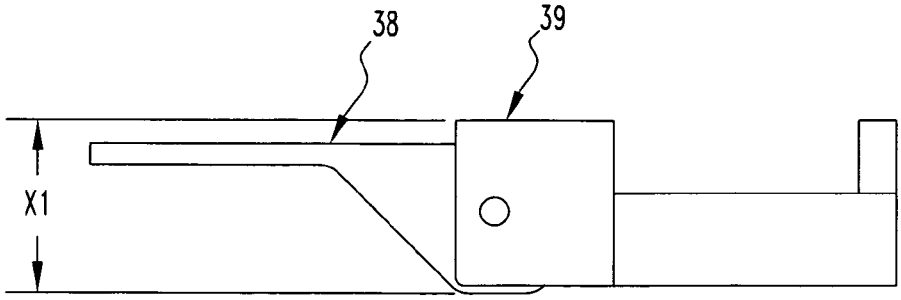
Figure 8C:
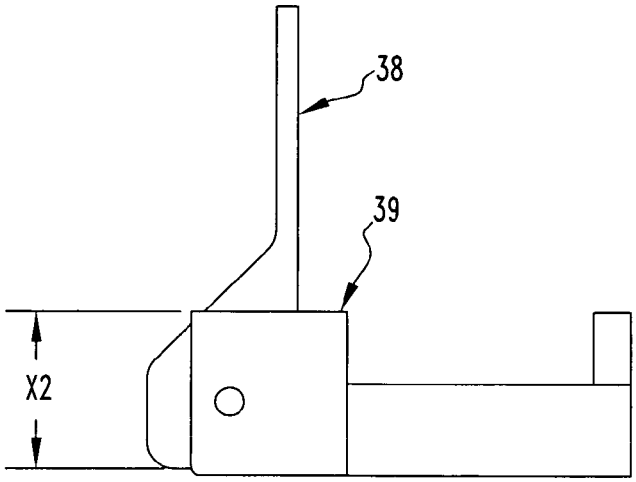

FIG. 8*a* shows the detail of the deck adjustment clamp 160. The clamp 160 consists of a clamp handle 38 and a clamp block 39. The clamp handle 38 is pivotally mounted to the clamp block 39. The clamp block 39 is configured such that it fits freely into the outer channel 40 of the outer deck rail 31 and is slidable along the length of the outer deck rail 31. Furthermore, the clamp block 39 is keyed to the top and bottom cross bars 37 of the adjacent deck half assembly. The clamp handle 38 is attached to the clamp block 39 in such a manner that in the effective height X1 (engaged position), X2 (disengaged position) of the deck clamp assembly is larger in the engaged position than it is in the disengaged position. See FIGS. 8*b* and 8*c*.

Figure 9B:
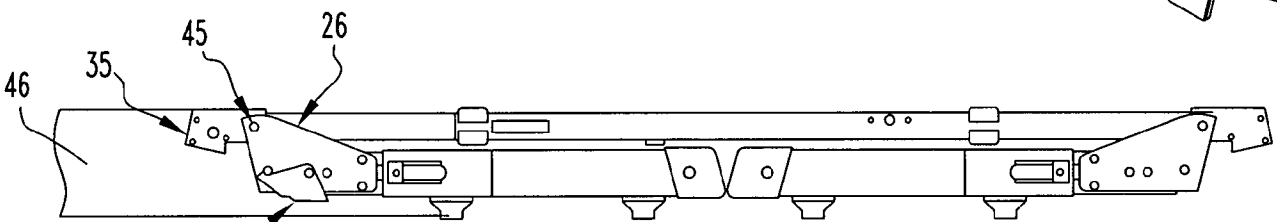
Figure 9C:
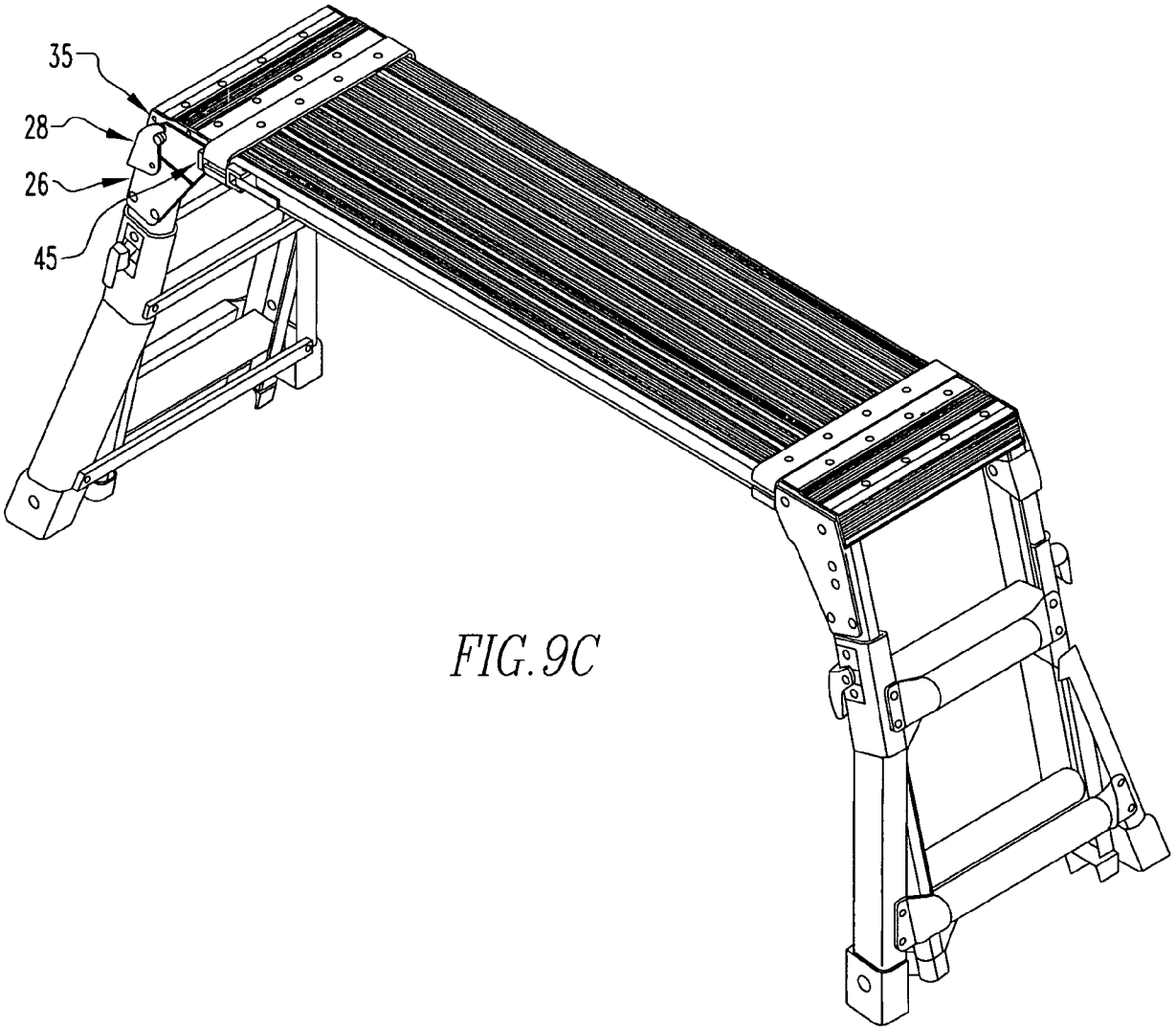

The deck assembly 150 FIG. 7 is pivotally attached to the inner ladder assembly 3 FIG. 6, by way of the steel pivot brackets 26, 35 and 27, 34. FIGS. 9*a*, 9*b*, and 9*c* show the collapsed and unfolded or working views of the platform 200. In the unfolded or working view (FIG. 9*c*) the top surface 42 (FIG. 6) of rail cap 25 rests under and serves as a stop for the deck end extrusion 33. Also, the side latch 28 (FIG. 6) on the steel pivot bracket 26 is engaged around a pin 44 (FIG. 7*a*) mounted on the steel pivot bracket 35. This latch assembly engages automatically as it is biased in the engaged direction by a coil spring.

FIG. 9*a* shows the platform 200 in its collapsed or storage position. The platform 200 is collapsed by depressing the latch 28 to disengage it from the pin 44. The ladder section is then folded inward and under the deck section. The pivot 45 is designed such that when in the collapsed position the thickness 46 of the platform 200 and legs is kept at a minimal height.

Vertical Height Adjustment and Latch Operation

Figure 10A:
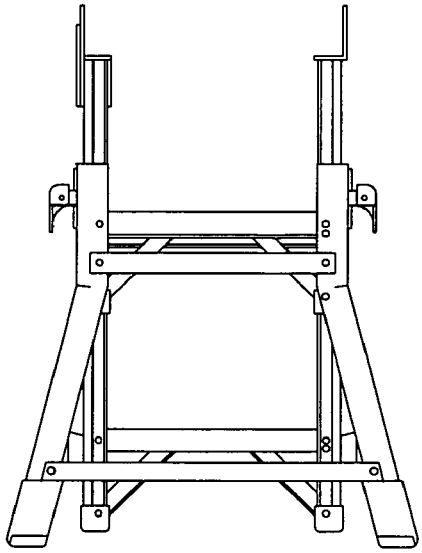
FIGS. 10*a*-10*d* show the ladder section in various positions.
Figure 10B:
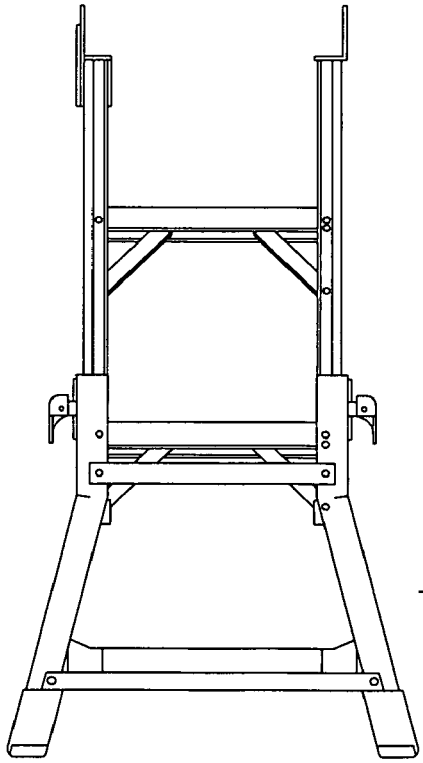
Figure 10C:
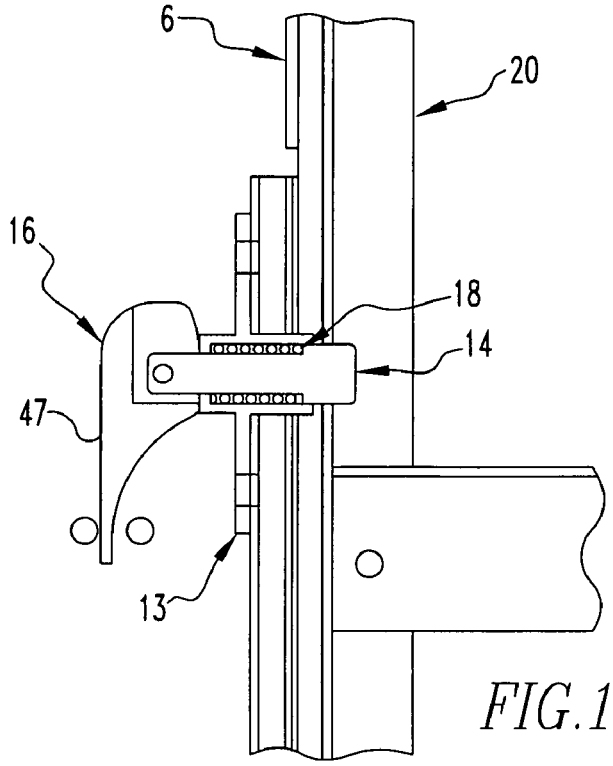
Figure 10D:
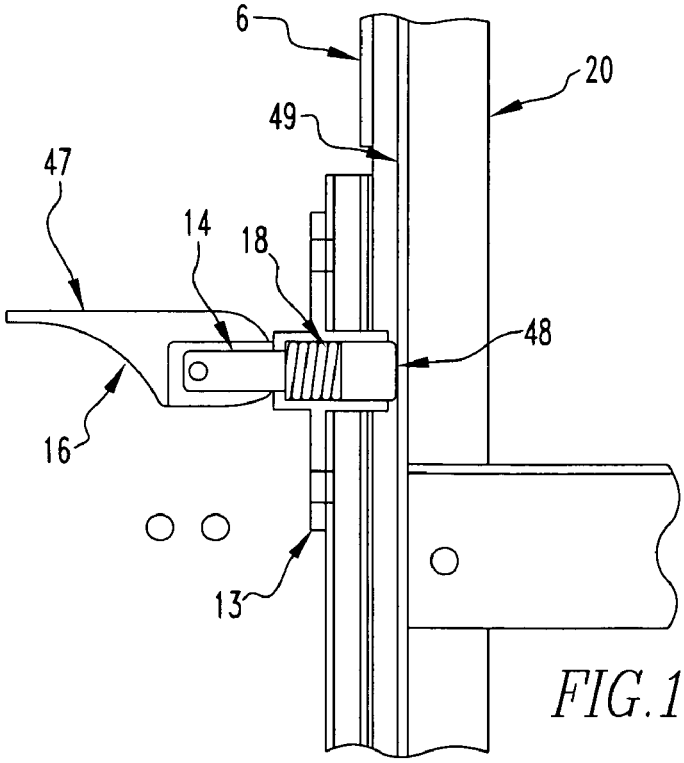

FIGS. 10*a* and 10*b* show the collapsed and extended position of the ladder assembly of FIG. 3. The latch assembly shown in FIG. 5, which controls the height adjustment, has two positions, engaged and disengaged. FIGS. 10*c* and 10*d* show section views of the latch mechanism 28 in its engaged and disengaged positions, respectively. In the engaged position portion 47 of the release handle 16 is substantially parallel to the outer rail 6,7. Also, the latch pin 14 passes through a position hole 23 (FIG. 6) in the inner rail 20, 21 and the latch housing 13, which is rigidly connected to the outer rail 6, 7. A compression spring 18 biases the latch pin 14 in this direction. This connects the inner ladder assembly 3 FIG. 6 to the outer ladder assembly 2 FIG. 4 and prevents any relative movement between the two.

In the disengaged position the portion 47 of the release handle 16 is substantially perpendicular to the outer rail. See FIG. 10*d*. Also, the latch pin 14 only passes through the latch housing 13. The inner ladder assembly 3 is now free to move up or down relative to the outer rail assembly. The release handle 16 can now be moved to the engaged position FIG. 10*c*. Surface 48 of the latch pin 14 will ride on surface 49 of the inner ladder rail until a position hole 23 comes in alignment with the latch pin 14. Since the latch pin 14 is biased to the engaged position the latch mechanism 28 will automatically engage and pass through the position hole 23 (see FIG. 6) of the inner ladder rail 20, 21. The outer ladder assembly 2 and inner ladder assembly 3 are locked in position again.

Horizontal Deck Adjustment and Latch Operation

Figures 11A, 11B, 11C:
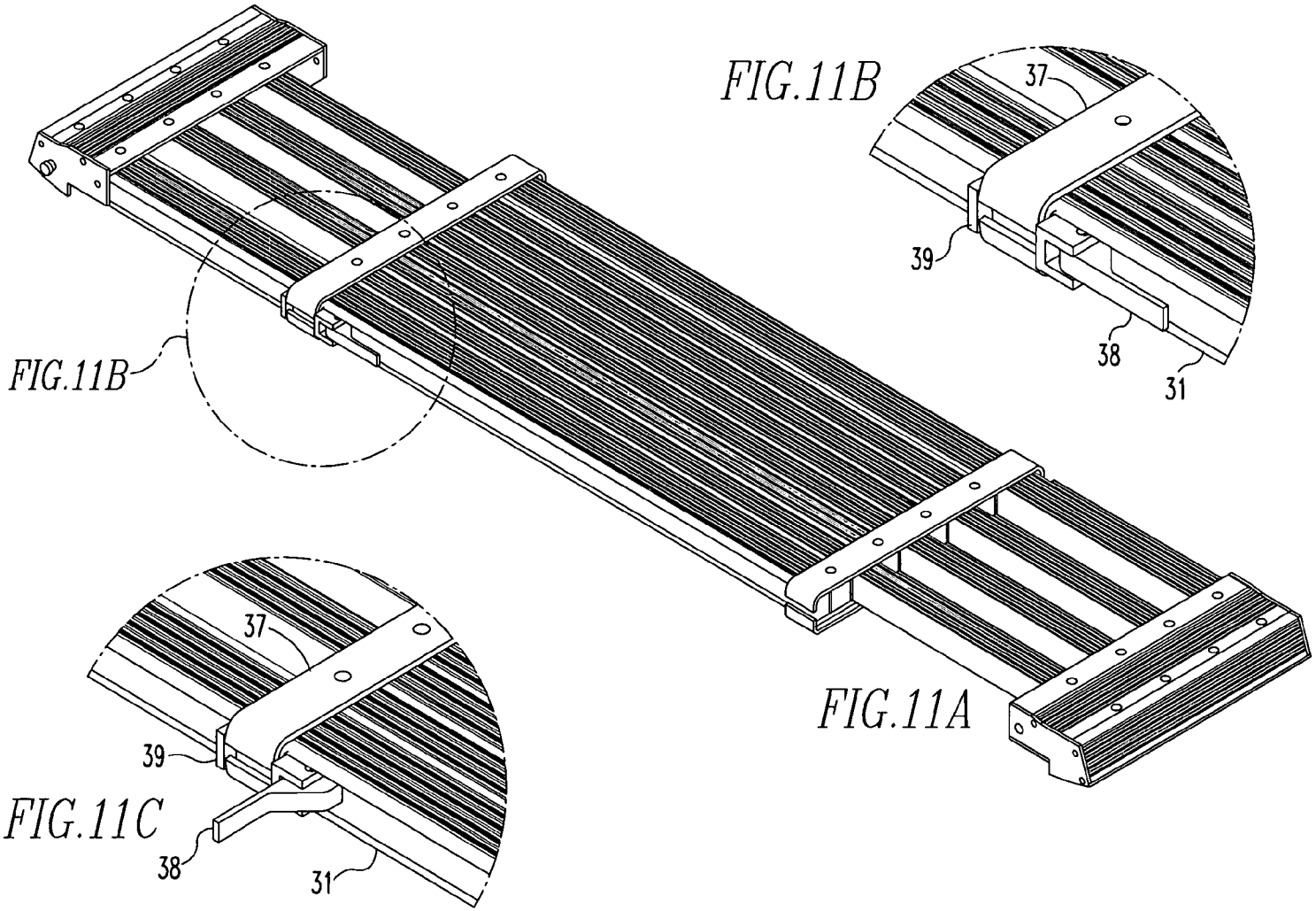
FIGS. 11*a*-11*c* show the deck assembly in various positions.

The horizontal length of the deck assembly 150, shown in FIG. 11*a*, is infinitely adjustable in length from 46 inches to 72 inches. The latch assembly 8 that controls the length adjustment has two positions, engaged and disengaged. See FIGS. 1*b* and 11*c*, respectively. In the disengaged position, the release handle 38 will extend substantially perpendicular to the longitudinal direction of the outer deck rail 31. See FIG. 11*c*. This position allows the clamp block 39 to move freely in the outer deck rail 31. The clamp block 39 is guided longitudinally along the outer deck rail 31 by the cross bars 37 of the adjacent half deck assembly 120*a*. The deck length can be adjusted to any position between 46 inches and 72 inches by applying a force to either deck half in the direction desired. To engage the deck clamp, rotate the release handle 38 such that it is substantially parallel to the longitudinal direction of the outer deck rail 31. In this position, surface 53 of the release handle 38 will engage and exert a force on surface 54 of the outer deck rail 31 and surface 55 of the clamp block 39 will exert a force on surface 56 of the outer deck rail 31. This force will be substantial enough as to prevent the clamp block 39 from sliding relative to the outer deck rail 31. See FIGS. 13*a* and 13*b*. Also, since the clamp block 39 is keyed to the cross bars 37 of the adjacent deck half, the two deck halves will be locked in position relative to each other. Furthermore, as shown in FIG. 12, a positive stop 50 is rigidly attached to the bottom surface 51 of one inner rail 32. Surface 52 of stop 50 will hit the face of cross bar 37, preventing the deck from extending too far. This stop 50 is located such that it allows for maximum horizontal adjustment of the deck assembly 150.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An adjustable work platform comprising:

a first aluminum ladder section and a second aluminum ladder section, each of which is adjustable in height, each ladder section includes an outer ladder assembly and an inner ladder assembly that move relative to each other, each outer ladder assembly includes a first outer rail and a second outer rail, each ladder section includes a first latch assembly and a second latch assembly, and each first outer rail and each second outer rail have a hole through which the first and second latch assemblies mount to the first and second outer rails, respectively; and an aluminum deck assembly adjustable in length supported by and pivotally attached to the first and second ladder sections, the deck assembly includes a first deck half and a second deck half that slide relative to each other and fit together, each deck half has an outer deck rail and a plurality of inner deck rails, the inner deck rails of the first deck half fit between the inner deck rails of the second deck half, the deck assembly includes a deck end extrusion, rail guides and a top cross bar and a bottom cross bar, and each outer and inner deck rail are attached to the deck end extrusion, corresponding rail guides and the top and bottom crossbars, each ladder section folds onto the deck section into a collapsed position; each outer ladder assembly includes a top rung and a lower rung, and the first outer rail and the second outer rail are connected by the top rung and the lower rung; each inner ladder assembly includes a first inner rail and a second inner rail, and a first step and a second step which are attached to the first and second inner rails; the inner ladder assembly includes a pivot plate attached to each inner rail, and a latch mechanism pivotally attached to each inner rail and the pivot plate, the deck assembly pivotally attached to each inner ladder assembly through each of the pivot plates; wherein the deck assembly includes a deck adjustment clamp for securing each deck half together; wherein the deck adjustment clamp includes a clamp block and a clamp handle pivotally amounted to the clamp block, the clamp block is keyed to the top and bottom cross bars of one of the deck half; the clamp block fits within and slides freely into an outer channel of the outer deck rail the other deck half and along the length of the outer deck rail of the other deck half, and in an engaged position, the clamp handle clamps against the outer deck rail of the other deck half to hold the outer deck rail of the other deck half in place and in a disengaged position allows the outer rail of the other deck half to move relative to the clamp block.

2. A platform as described in claim 1 wherein the first latch assembly includes a latch housing having a hole attached to the first outer rail, a latch pin which fits through the hole in the first outer rail and the hole in the latch housing, a release handle pivotally fixed to the latch pin by a connection pin, the latch pin is inwardly biased by a compression spring.

3. A platform as described in claim 1 wherein each outer rail flares outwardly.

4. A platform as described in claim 3 wherein each inner rail has a plurality of holes, the height of each ladder section set by the hole of the inner rail through which the latch pin of the latch assembly extends.

5. A platform as described in claim 4 wherein the deck assembly includes a stop for preventing the first and second deck halves from extending too far and separating from each other.

6. A method for using an adjustable work platform comprising the steps of:

extending the height of a first aluminum ladder section and a second aluminum ladder section by moving an inner ladder assembly relative to an outer ladder assembly of each ladder section, each outer ladder assembly includes a first outer rail and a second outer rail, each ladder section includes a first latch assembly and a second latch assembly, and each first outer rail and each second outer rail have a hole through which the first and second latch assemblies mount to the first and second outer rails, respectively; and sliding a first aluminum deck half relative to a second aluminum deck half that fit together of an aluminum deck assembly to a desired length, the deck assembly supported by and pivotally attached to the first and second ladder sections, each deck half has an outer deck rail and a plurality of inner deck rails, the inner deck rails of the first deck half fit between the inner deck rails of the second deck half, the deck assembly includes a deck end extrusion, rail guides and a top cross bar and a bottom cross bar, and each outer and inner deck rail are attached to the deck end extrusion, corresponding rail guides and the top and bottom crossbars; including the step of folding the first and second ladder sections onto the deck assembly into a collapsed position; each outer ladder assembly includes a top rung and a lower rung, and the first outer rail and the second outer rail are connected by the top rung and the lower rung; each inner ladder assembly includes a first inner rail and a second inner rail, and a first step and a second step which are attached to the first and second inner rails; the inner ladder assembly includes a pivot plate attached to each inner rail, and a latch mechanism pivotally attached to each inner rail and the pivot plate, the deck assembly pivotally attached to each inner ladder assembly through each of the pivot plates; including the step of setting a deck adjustment clamp into an engaged position against the outer deck rail of the deck assembly to hold the outer deck rail in place for securing each deck half together; wherein the deck adjustment clamp includes a clamp block and a clamp handle pivotally amounted to the clamp block, the clamp block is keyed to the top and bottom cross bars of one of the deck half; the clamp block fits within and slides freely into an outer channel of the outer deck rail the other deck half and along the length of the outer deck rail of the other deck half, and in the engaged position, the clamp handle clamps against the outer deck rail of the other deck half to hold the outer deck rail of the other deck half in place and in a disengaged position allows the outer rail of the other deck half to move relative to the clamp block.

7. A method as described in claim 6 including the step of placing the first latch assembly and through a hole of a first inner rail and a second inner rail, respectively, of the inner ladder assembly to lock the inner ladder assembly to the outer ladder assembly.

* * * * *